US011197559B2

(12) United States Patent
Norquist et al.

(10) Patent No.: US 11,197,559 B2
(45) Date of Patent: Dec. 14, 2021

(54) HIGH CHAIR SECURED TO PICNIC TABLE

(71) Applicant: PlayCore Wisconsin, Inc., Chattanooga, TN (US)

(72) Inventors: Thomas Robert Norquist, Fort Payne, AL (US); Salil Shriram Vaijapurkar, Chattanooga, TN (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

(21) Appl. No.: 16/856,482

(22) Filed: Apr. 23, 2020

(65) Prior Publication Data

US 2020/0337474 A1 Oct. 29, 2020

Related U.S. Application Data

(60) Provisional application No. 62/839,441, filed on Apr. 26, 2019.

(51) Int. Cl.
*A47D 1/10* (2006.01)
*A47D 1/00* (2006.01)

(52) U.S. Cl.
CPC ..... *A47D 1/106* (2013.01); *A47D 1/002* (2013.01); *A47D 1/008* (2013.01)

(58) Field of Classification Search
CPC . A47D 1/106; A47D 1/10; A47D 3/00; A47D 1/002; A47D 1/006; A47D 3/001; A47D 3/005; A47D 1/008
USPC .... 297/174 CS, 174 R, 140, 143, 217.7, 148
See application file for complete search history.

(56) References Cited

U.S. PATENT DOCUMENTS

| | | | | | |
|---|---|---|---|---|---|
| 275,508 | A * | 4/1883 | Miles | A47D 1/106 | 297/174 CS |
| 2,550,352 | A * | 4/1951 | Hodgson | A47D 1/106 | 297/16.1 |
| 3,330,597 | A * | 7/1967 | Lay | A47D 1/002 | 297/148 |
| 4,511,177 | A * | 4/1985 | O'Sullivan | A47D 1/106 | 297/136 |
| 4,818,016 | A * | 4/1989 | Mariol | A47D 1/106 | 297/153 |
| 4,844,537 | A * | 7/1989 | Reed | A47D 1/004 | 297/174 R |
| 7,677,663 | B1 * | 3/2010 | Charles | B63B 29/12 | 297/256.12 |

(Continued)

FOREIGN PATENT DOCUMENTS

| | | | | |
|---|---|---|---|---|
| CH | 282312 A * | 4/1952 | ..... | A47D 1/106 |
| FR | 2329233 A2 * | 5/1977 | ..... | A47D 1/106 |

*Primary Examiner* — Milton Nelson, Jr.
(74) *Attorney, Agent, or Firm* — McAndrews, Held & Malloy, Ltd.

(57) ABSTRACT

The present disclosure is directed to a high chair that is permanently secured to a picnic table to facilitate the public enjoyment of communal meals and recreational time by families that include small children. In some embodiments, the high chair may be configured to extend above the upper surface of the picnic table, providing the additional benefit of facilitating interaction and attunement between a child occupant of the high chair and adult occupants of the picnic table bench seats. In other embodiments, the high chair may be configured such that a food tray of the high chair is substantially level with the upper surface of the picnic table.

18 Claims, 15 Drawing Sheets

(56) References Cited

U.S. PATENT DOCUMENTS

2004/0218993 A1* 11/2004 Nowak, Jr. ..... F16B 23/0069
411/402
2019/0365118 A1* 12/2019 Stachowski ..... A47D 15/006

* cited by examiner

HIGH CHAIR SECURED TO PICNIC TABLE

This application claims priority to U.S. Provisional Patent Application No. 62/839,441, filed Apr. 26, 2019, the entirety of which is incorporated by reference herein.

BACKGROUND OF THE INVENTION

Often, a family trip to a recreational space such as a park, playground, zoo, etc., involves at least one meal. As a result, picnic tables may be found at most recreational spaces.

Picnic tables are fairly standardized and contain a rectangular table having an upper surface for supporting food and drink items and a bench seat positioned on each long side of the table, each bench seat spanning the length of the table. The table and the bench seats are connected to and supported by a frame, which typically fall into one of a small number of categories, which are defined by the general shape of the frame when viewed along the width of the picnic table: a "V"-frame, an "H"-frame, or an "X"-frame. Picnic tables are also generally made out of metal, wood or a suitable synthetic material, or a combination thereof.

While picnic tables provide adequate seating for families of many sizes, they do not provide seating specially configured for small children such as infants and toddlers. Accordingly, a caretaker is often forced into attempting to hold and feed a small child while at the same time feeding him or herself, a task that may be manageable but is rarely enjoyable for the caretaker. Alternatively, one may place a small child into a stroller and attempt to feed the child in the stroller. This is less than ideal, however, both because strollers are not designed to serve that function and because the child is positioned well below the table surface and thus cannot reasonably interact with the rest of the family.

The present invention is directed to a high chair that is configured to be secured to a picnic table, e.g. any of a variety of existing conventional picnic tables, to facilitate the enjoyment of a communal meal by a family that includes a small child. The high chair may be permanently secured to a conventional picnic table so as to provide a picnic table that is located in a public space and modified to facilitate such a family meal. Accordingly, the high chair may be configured to withstand both an outdoors environment and the potential of theft and/or loss of components by members of the public. By permanently secured, it is not meant that the high chair is non-removable from the picnic table. Rather, it is meant that the high chair is configured and meant to remain secured to the picnic table continuously over a long period of time, e.g. years, rather than being removed and transported by individual families for a particular use. In other words, the high chair of the present disclosure is distinguished from user-owned or personal use high chairs, which would need to be transported to and from a picnic table by each family.

In some embodiments, the high chair may also be configured to extend a defined distance above the upper surface of the table, providing the additional benefit of facilitating interaction and attunement between a child occupant of the high chair and adult occupants of the picnic table bench seats.

SUMMARY OF THE INVENTION

Embodiments of the present disclosure are directed to a high chair configured to be secured to a picnic table, a high chair secured to a picnic table, a picnic table having a high chair secured thereto, and a method of promoting mealtime interaction and attunement between a caretaker and a child by providing a picnic table that is modified to have a high chair secured thereto.

Embodiments of the high chair comprise a child seat and a connector.

The child seat may include a base, a child support structure, and a tray. The base is configured to provide a surface upon which a child may sit and support the weight of the child. The support structure is configured to assist the child to maintain a sitting position and may include a back support portion and one or more side portions. The tray is configured to provide a surface for holding food and drink items within easy reach of a child occupant of the seat. The child seat may also include a divider spanning from the base to the tray and defining a pair of openings through which the legs of a child may be inserted to help hold the child in the seat. In some embodiments, the child seat may be an integral unit that is produced from molded plastic. The child seat may be configured for use by children having a variety of ages. For instance, in some embodiments, the child seat may be configured for use by children of age one through age four.

The connector is configured to support the child seat and to be secured to the frame of a picnic table. The connector may include a first end that is attached to the child seat and a second end that is configured to be secured to the frame of a picnic table. In some embodiments, the connector may be configured to be secured to a V-frame of a picnic table, an H-frame of a picnic table, an X-frame of a picnic table, or any combination thereof.

The connector, and in particular the second end of the connector, may comprise one or more mounting plates that are securable to the frame of a picnic table. In some embodiments, the second end of the connector may comprise a plurality of mounting plates, which provide the high chair with enhanced stability. For example, the connector may comprise a first mounting plate and a second mounting plate, the first and second mounting plates being vertically spaced from one another so as to be secured to different vertical portions of the picnic table frame. Each of the first and second mounting plates may extend horizontally at least a width of the picnic table frame, such that a first end of the mounting plate may be secured to a first leg of the picnic table and a second end of the mounting plate may be secured to a second leg of the picnic table. The connector may also include one or more back plates that are configured to interact with the one or more mounting plates, such as through the inclusion of fasteners, to secure the connector to the picnic table frame. At least one of the fasteners may be a tamper-resistant fastener which helps prevent undesired removal of the high chair from the picnic table.

In some embodiments, the connector may comprise a ground support element configured to contact a ground surface so as to distribute weight from the child seat to the ground. The ground support element may have a lower end that comprises a flange that rests on and may be secured to the ground surface. In other embodiments, the lower end of the ground support element may be positioned below the ground surface, e.g. by being held within natural earth, a concrete foundation, or the like.

In some embodiments, the connector may comprise a piped framework. The piped framework may be made of any of a variety of materials. In some embodiments, the piped framework may be made of metal and may be treated so as to be weather-resistant. For instance, the piped framework may be made of stainless steel tubing/piping, galvanized steel tubing/piping, or the like. The piped framework may comprise a first, or primary, portion and a second, or stabilizing portion, that is vertically spaced from the primary portion and that is configured to provide the high chair with enhanced stability. The primary portion may comprise a first mounting plate and the stabilizing portion may comprise a second mounting plate.

Embodiments of the high chair are configured to be secured to a picnic table so as to position the base of the child seat above the top surface of the picnic table, thereby facilitating interaction and attunement between a child occupant of the high chair and one or more adult occupants of the picnic table seats. In some embodiments, for example, the high chair may be secured to the picnic table so that a child occupant of the high chair and an adult occupant of one of the picnic table bench seats are at substantially the same eye level.

For instance, in some embodiments, the high chair may be secured to the picnic table so that the base of the child seat is positioned at least two inches above the upper surface of the picnic table, alternatively at least three inches above the upper surface of the picnic table, alternatively at least four inches above the upper surface of the picnic table, alternatively at least five inches above the upper surface of the picnic table. Similarly, in some embodiments, the high chair may be secured to the picnic table so that the base of the child seat is positioned at least twelve inches above a bench seat of the picnic table, alternatively at least thirteen inches above a bench seat of the picnic table, alternatively at least fourteen inches above a bench seat of the picnic table, alternatively at least fifteen inches above a bench seat of the picnic table.

Embodiments of the high chair are also configured to be secured to a picnic table so as to position the tray of the child seat substantially level with the upper surface of the picnic table.

Embodiments of the present disclosure are further directed to a picnic table comprising a high chair of any of the embodiments described herein secured thereto.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
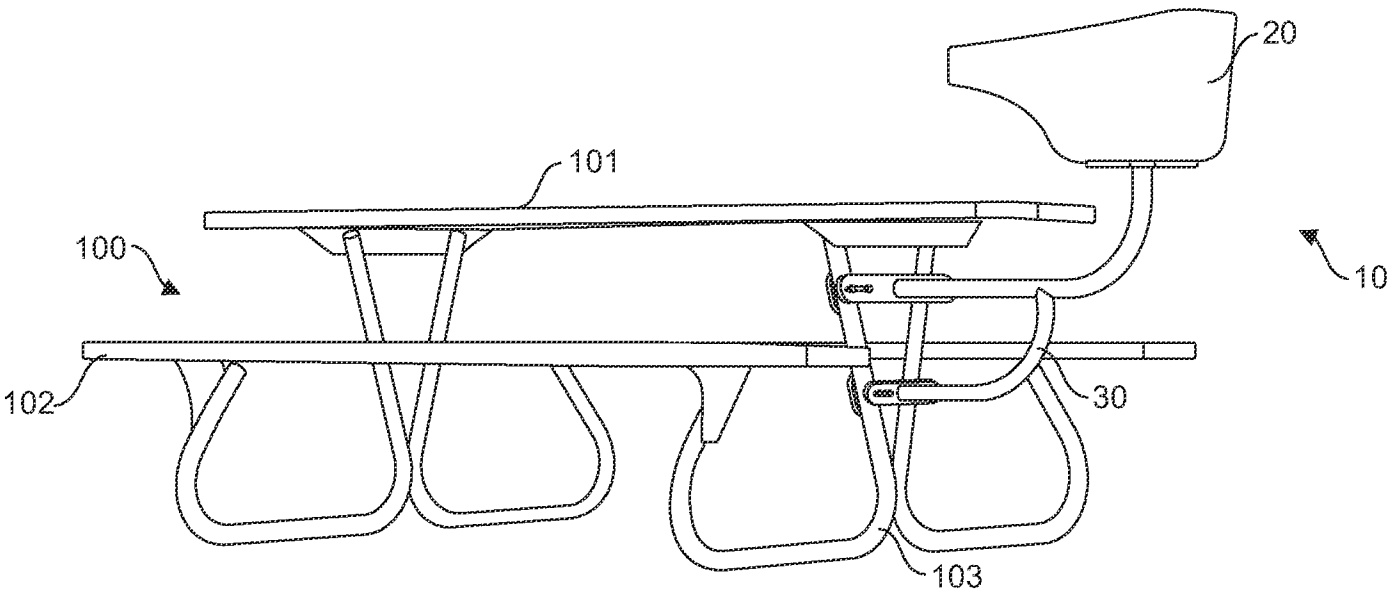
FIG. 1 is a perspective view of an embodiment of a high chair secured to a "V"-frame of a picnic table.

Embodiments of the present disclosure are directed to a high chair 10 configured to be secured to a picnic table 100 and more particularly to the frame 103 of a picnic table.

A conventional picnic table 100 comprises a top dining surface 101, a pair of bench seats 102, and a frame 103 that connects the dining surface to each of the bench seats and supports the dining surface and the bench seats at desired heights above a ground surface. The frame 103 of most conventional picnic tables 100 is one of a V-frame, an H-frame, or an X-frame. Embodiments of the high chair 10 of the present disclosure may be configured to be secured to one or more different types of picnic table frames.

Figure 4:
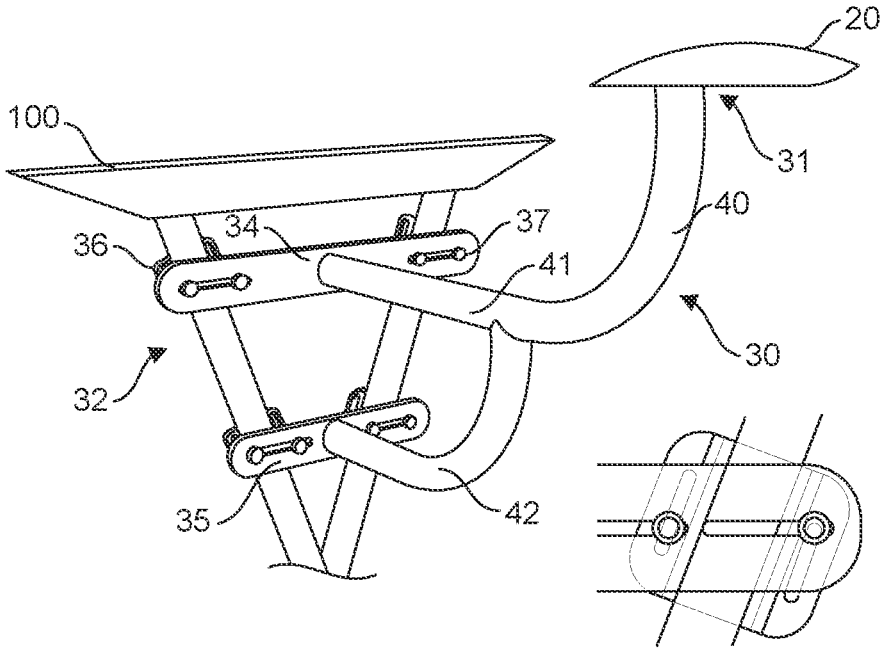
FIG. 4 is a perspective view of a connector element of an embodiment of a high chair, showing one manner in which the connector element may be secured to a "V"-frame of a picnic table.
Figure 5:
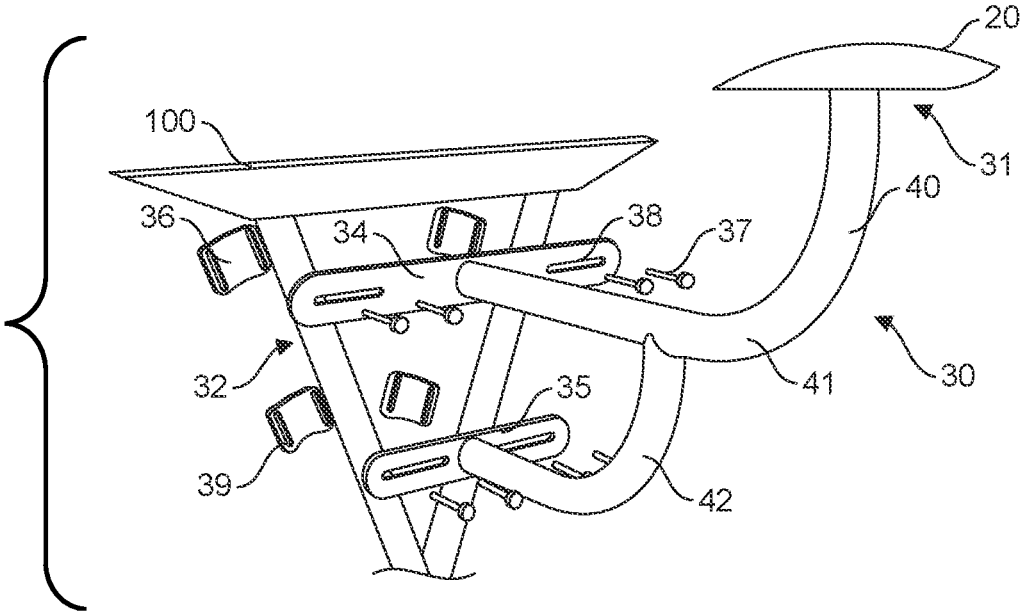
FIG. 5 is an exploded perspective view of the connector element of the embodiment shown in FIG. 4.
Figure 6:
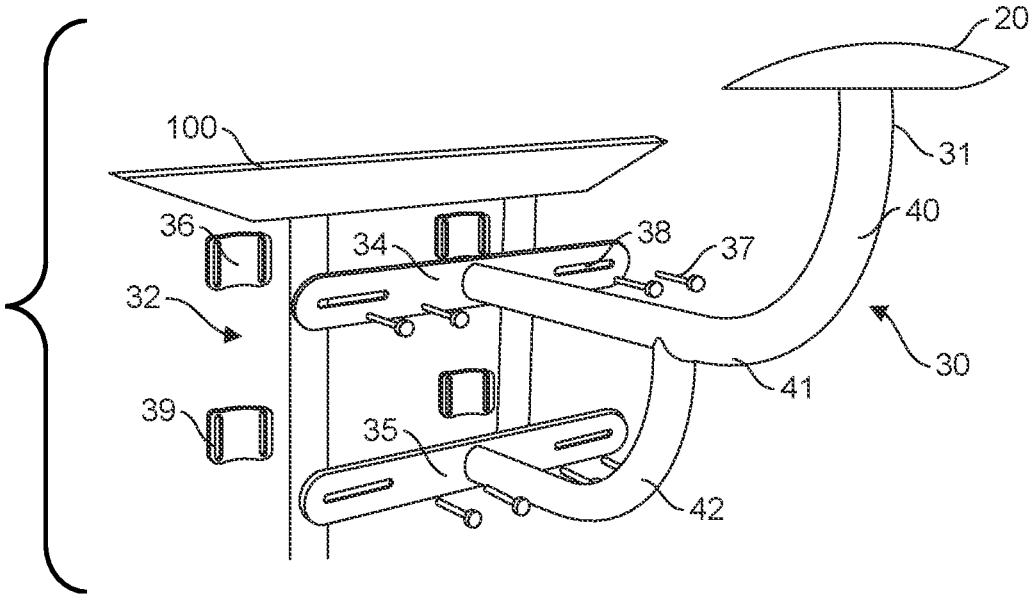
FIG. 6 is an exploded perspective view of a connector element of an embodiment of a high chair, showing one manner in which the connector element may be secured to an "H"-frame of a picnic table.

In some embodiments, the high chair 10 may be configured to be secured to a "V"-frame of a picnic table. An example of a high chair 10 secured to a "V"-frame picnic table 100 is shown in FIGS. 1 and 4-5. In other embodiments, the high chair 10 may be configured to be secured to an "H"-frame of a picnic table. An example of a high chair 10 secured to an "H"-frame picnic table 100 is shown in FIG. 6. In other embodiments, the high chair 10 may be configured to be secured to an "X"-frame of a picnic table, as such is a standard design for a wooden picnic table.

In some embodiments, the high chair 10 may be configured to be secured to more than one different type of picnic table 100. For instance, in some embodiments, the high chair 10 may be configured to be secured to any combination of "V"-frame picnic tables, "H"-frame picnic tables, and "X"-frame picnic tables. As shown in FIGS. 5 and 6, for example, an embodiment of high chair 10 may be configured to be secured to different types of picnic tables simply by replacing at least one of the first mounting plate 34 and/or the second mounting plate 35 with a first and/or second mounting plate having different dimensions.

The high chair 10 comprises at least a child seat 20 and a connector 30.

Figure 7:
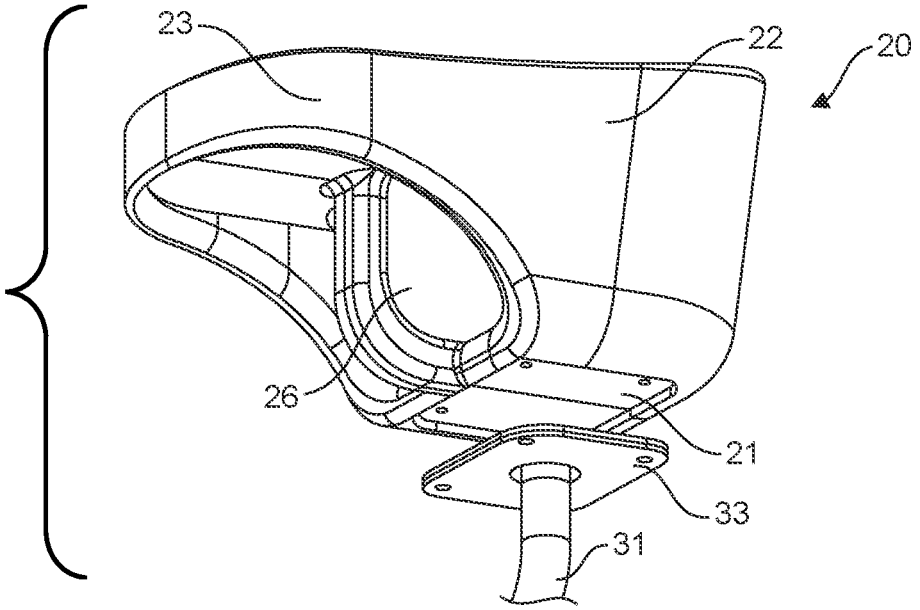
FIG. 7 is a lower perspective view of a child seat and the first end of a connector element of an embodiment of the high chair of the present disclosure.
Figure 8:
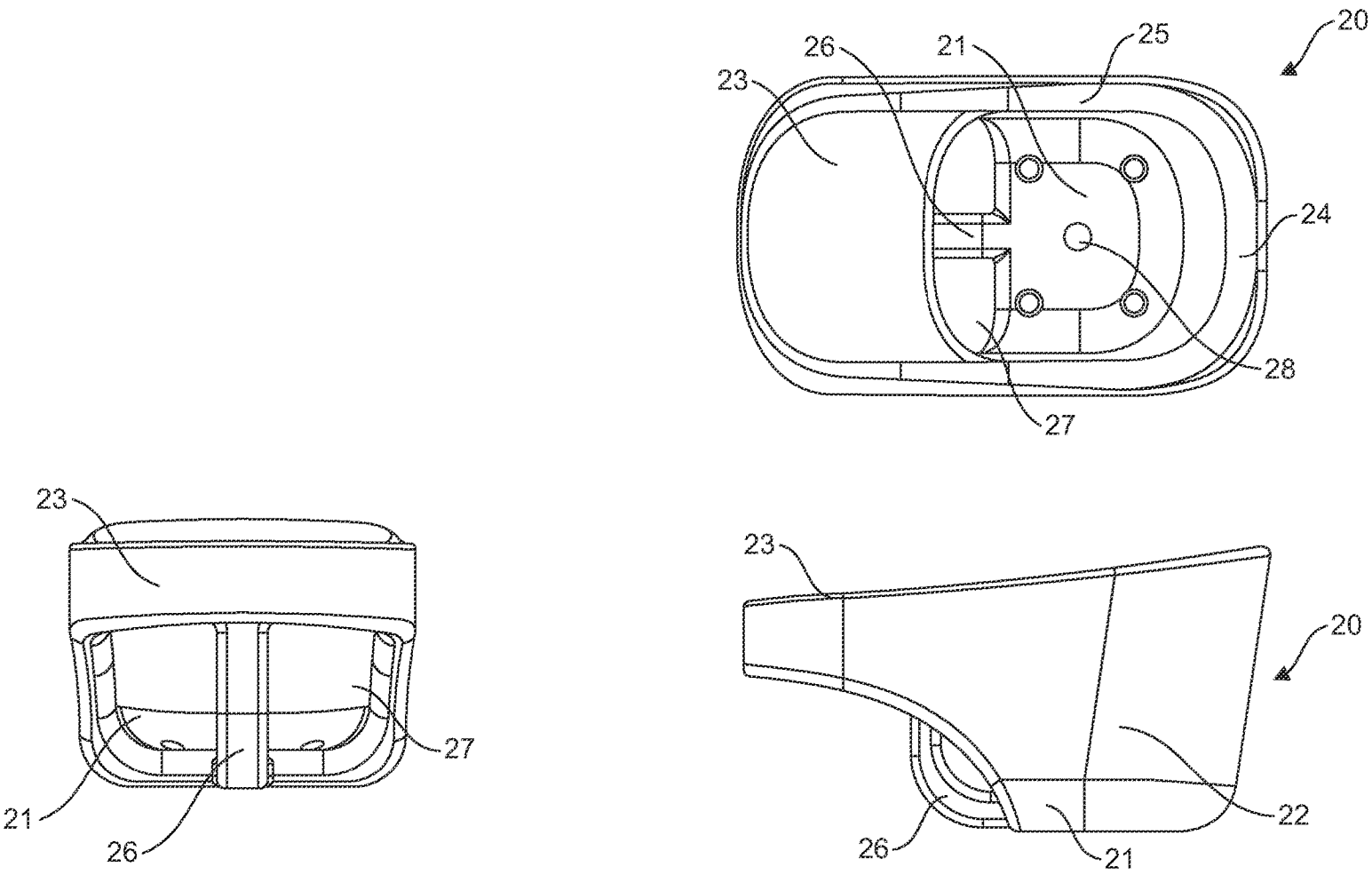
FIG. 8 is an upper plan view, front elevation view, and side elevation view of a child seat of an embodiment of the high chair of the present disclosure.
Figure 9:
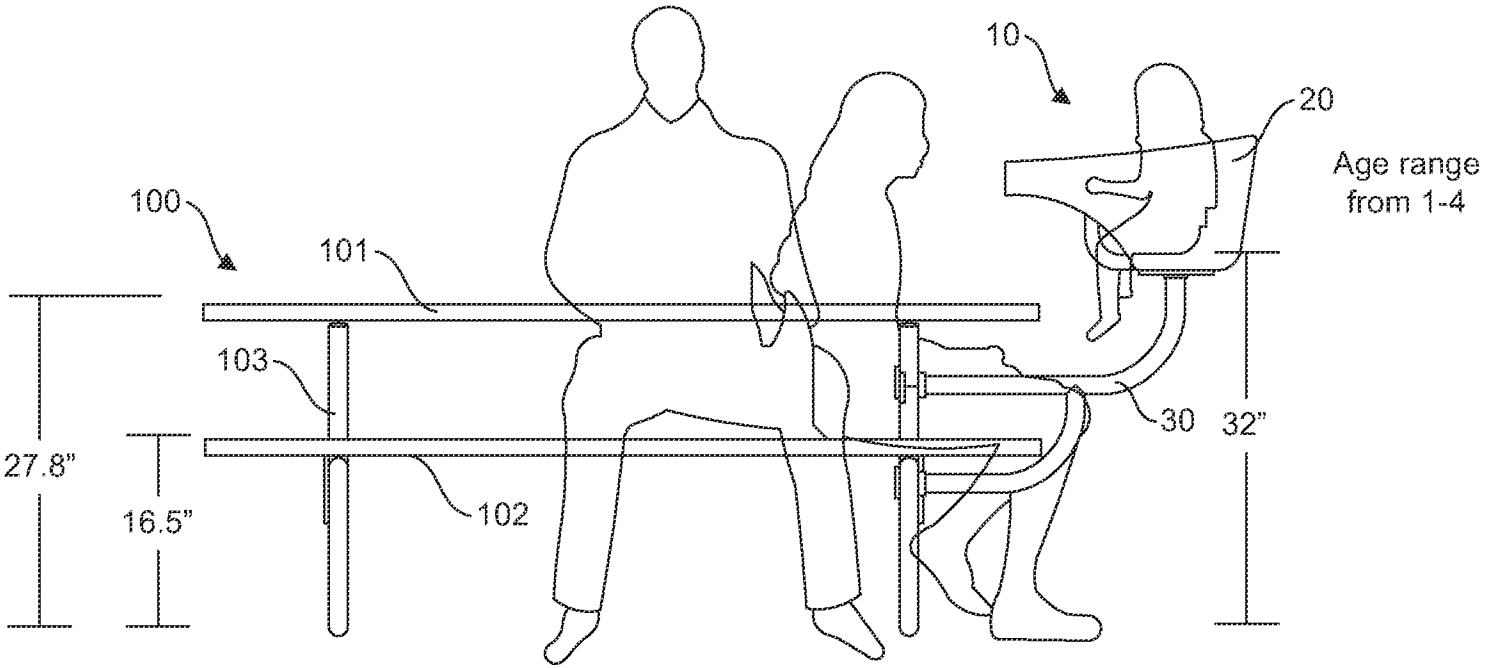
FIG. 9 is a side elevation view of an embodiment of the high chair of the present disclosure, showing the child seat configured to be positioned and positioned a defined distance above the upper surface of a picnic table so as to place a child occupant of the high chair and adult occupants of the picnic table seats at a common eye level.
Figure 10:
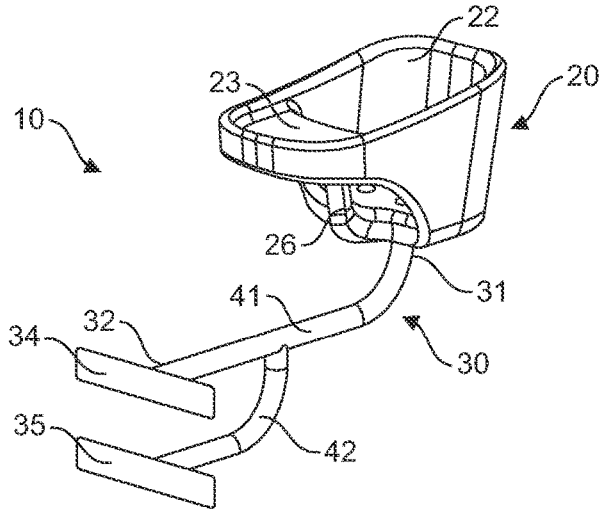
FIG. 10 is a front perspective view of an embodiment of a high chair of the present disclosure, configured to be positioned and secured to a picnic table such that the tray of the high chair is at substantially the same height as the upper surface of the picnic table.
Figure 11:
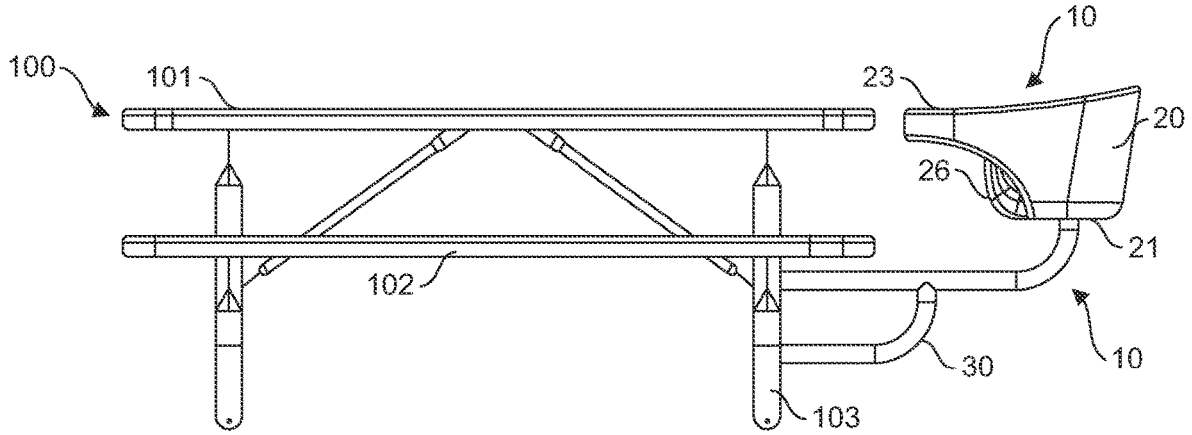
FIG. 11 is a side elevation view of the embodiment of FIG. 10, showing the high chair positioned and secured to a picnic table such that the tray is at substantially the same height as the upper surface of the picnic table.

An embodiment of a child seat 20 is shown in FIGS. 7 and 8. As shown in those Figures, the child seat 20 may include a base 21, a support structure 22, and a tray 23. The base 21 provides a surface upon which a child may sit. Accordingly, the base 21 is configured to support the weight of a child. The support structure 22 helps a child maintain a sitting position. For instance, the support structure 22 may include a back support portion 24. The support structure 22 may also include side portions 25, which create a bucket seat having walls along three edges of the base 21. The walls may be high enough to prevent the child from falling out of the child seat 20 thereby allowing for use of the child seat 20 without the need for any additional straps, buckles, or the like. In some embodiments, however, the child seat 20 may include one or more straps, buckles, or the like to secure a child within the seat.

The tray 23 is positioned at the front of the child seat 20 and is configured to hold food and drink items. In some embodiments, the tray 23 may also comprise one or more integrated toys. The child seat 20 may also include a divider 26, which extends between the front of the base 21 and the underside of the tray 23. The divider 26 may define a pair of openings 27 through which a child's legs may be inserted. As such, the divider 26 may help to keep the child in the child seat 20.

Although a child seat 20 having a particular arrangement and design is shown in FIGS. 7 and 8, child seats having a different arrangement of parts and a different design are also contemplated without departing from the scope of the present invention. For example, in some embodiments, the tray 23 may be movable relative to the body of the child seat 20, though in order to avoid loss or theft, the tray is desirably not fully removable from the child seat.

In some embodiments, the child seat 20 may be configured to be durable and weather-resistant. For instance, the child seat 20 may be made of strong, relatively thick components that can withstand repeated use by children. For instance, in some embodiments, including that shown in FIGS. 7 and 8, the child seat 20 may have no movable parts. The child seat 20 may also be made from materials that can withstand rain, snow, sunlight, temperature variations, and the like. In some embodiments, including that shown in FIGS. 7 and 8, the child seat 20 may be an integral unit that is produced from molded plastic. Any suitable plastic material may be used, including for example linear low density polyethylene (LLDPE) or other plastic materials that are commonly used for playground equipment. The base 21 of the child seat 20 may also comprise one or more apertures 28 that allow precipitation such as rain to drain out of the child seat. The surface of the base 21 may also be gently sloped toward the one or more apertures 28 to enhance the drainage effect. In other embodiments, the base 21 of the child seat 20 may be gently sloped toward the leg openings 27 to facilitate drainage of water through those openings.

The child seat 20 may be configured for use by children having a variety of ages. For instance, in some embodiments, the child seat 20 may be configured for use by children of ages one through age four. In other embodiments, the child seat 20 may be configured for use by children of ages two through three, by children of ages one through two, by children of ages one through three, or the like.

Embodiments of connectors 30 are shown in FIGS. 4 through 6. The connector 30 may comprise a first end 31 and a second end 32. The first end 31 of the connector 30 may be attached to the child seat 20. For instance, as shown in FIG. 7, the first end 31 of the connector 30 may be affixed to the child seat 20 by one or more fasteners. As illustrated, for example, the first end 31 of the connector 30 may include a flange 33 that is affixed to the underside of the base 21 of the child seat 20. The flange 33 and the base 21 of the child seat 20 may each comprise apertures through which a plurality of fasteners may be inserted to secure the child seat 20 to the connector 30. As shown in FIG. 8, each of the plurality of fasteners is preferably provided with a cover element that makes the fastener inaccessible from within the child seat 20. In other embodiments (not illustrated), the first end 31 of the connector 30 may be affixed to a different portion of the child seat 20, including for example to the back support portion 24, to the side support portions 25, or to a combination thereof. In yet other embodiments, the first end 31 of the connector 30 may be integrally attached to the child seat 20, such as by being molded from the same material as the child seat.

The second end 32 of the connector 30 may be configured to be secured to the frame of a picnic table 100. In some embodiments, for instance, the second end 32 of the connector may comprise one or more mounting plates. In some embodiments, the second end 32 of the connector may comprise at least a first mounting plate 34 and a second mounting plate 35. The first mounting plate 34 and the second mounting plate 35 may be vertically spaced apart from one another. Each mounting plate 34, 35 is configured for attachment to the frame of a picnic table. By providing at least two mounting plates 34, 35 vertically spaced apart, the high chair 10 may be secured to the picnic table frame in a manner that provides improved stability and strength.

Each mounting plate 34, 35 may extend horizontally such that a first end of the mounting plate may be affixed to a first leg of the picnic table frame and the second end of the mounting plate may be affixed to a second leg of the picnic table frame. By affixing each mounting plate 34, 35 to both legs of the picnic table frame, the connector 30 is provided with a stable connection to the picnic table 100 that limits movement of the high chair 10 relative to the picnic table 100.

Each mounting plate 34, 35 may be affixed to the picnic table frame in any of a variety of manners. In the embodiments illustrated in FIGS. 4 through 6, for example, the second end 32 of the connector 30 also comprises one or more back plates 36. The one or more back plates 36 may be attached to at least one of the mounting plates 34, 35 so as to affix the second end of the connector 32 to the picnic table frame. For example, a back plate 36 may be placed on the opposite side of the picnic table frame from the mounting plate 34, 35 and then the mounting plate and the back plate may be connected together by one or more fasteners 37, pressing a leg of the picnic table between the mounting plate and the back plate to secure the mounting plate to the picnic table leg. At least one of the fasteners 37 may be a tamper-resistant fastener, such as a fastener that requires a special tool to remove, in order to help prevent removal and/or theft of the high chair 10 from the picnic table 100.

In some embodiments, at least one of the first end and the second end of each mounting plate 34, 35, and desirably both ends of each mounting plate, may comprise an aperture 38, e.g. a slot, that spans a distance along the length of the mounting plate. By providing an aperture 38 that spans a distance along the length of the mounting plate 34, 35, the mounting plate may be configured to be affixed to a leg of a picnic table frame where that leg may have a variety of different dimensions, e.g. widths or diameters. If the aperture 38 extends a great enough distance along the length of the mounting plate 34, 35, the mounting plate may also be configured to be affixed to first and second legs of a picnic table frame that have a variety of horizontal spacings between the first and second legs. Each of these allows the connector 30 to be secured to a variety of existing picnic tables 100 and avoids the need to produce independent components for each picnic table. Similarly, each of the back plates 36 may comprise one or more apertures 39, e.g. slots, that extends along a length and/or height of the back plate to provide added flexibility in mounting.

Although a connector 30 having a particular mounting mechanism is shown in FIGS. 4 through 6, connectors having a different mounting mechanism are also contemplated without departing from the scope of the present invention. For example, the second end 32 of the connector 30 may comprise a plurality of conventional clamps that may be sized and/or adjusted to clamp around the legs of a picnic table frame. In addition, for wooden picnic table frames, the second end 32 of the connector 30 may comprise one or more fasteners that extend into or through a portion of the wooden leg (e.g. screws and the like).

Figure 12:
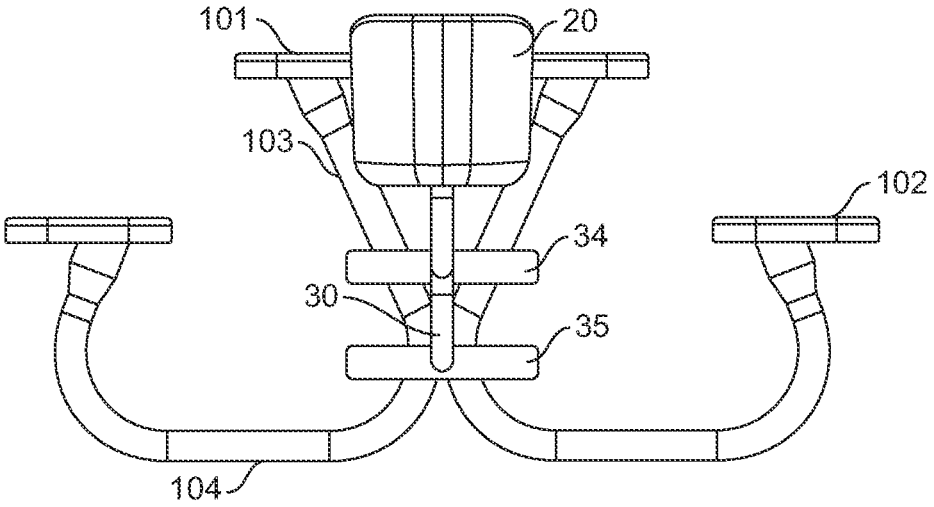
FIG. 12 is a rear elevation view of the embodiment of FIG. 10, showing the high chair positioned and secured to a V-frame picnic table such that the tray is at substantially the same height as the upper surface of the picnic table.
Figure 13:
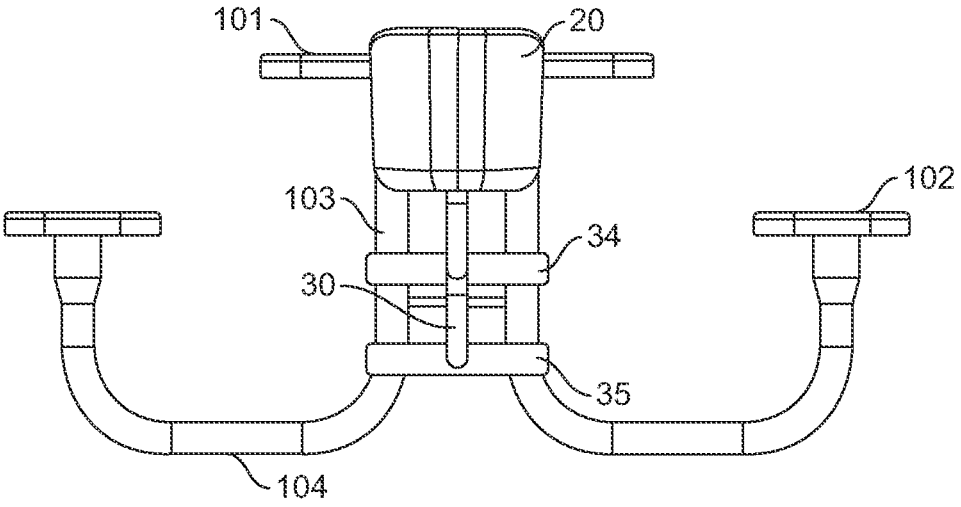
FIG. 13 is a rear elevation view of the embodiment of FIG. 10, showing the high chair positioned and secured to an H-frame picnic table such that the tray is at substantially the same height as the upper surface of the picnic table.

In some embodiments, at least one of the first and/or second mounting plates 34, 35 may be configured to be secured to a lower portion of a picnic table frame 103 in order to provide enhanced stability. For example, in some embodiments, the lower mounting plate 35 may be configured so as to be secured to a central, convergence point of a V-frame (e.g. as shown in FIG. 12) or to a portion of the V-frame below the central, convergence point. The upper mounting plate 34 may optionally be secured to a portion of the V-frame at or near the central, convergence point (e.g. as shown in FIG. 12). Similarly, in some embodiments, the lower mounting plate 35 may be configured so as to be secured to a portion of an H-frame that is below the cross-bar of the "H" (e.g. as shown in FIG. 13). The upper mounting plate 34 may optionally be secured to a portion of the H-frame at or near the cross-bar of the "H" (e.g. as shown in FIG. 13). In yet other, non-illustrated embodiments, one or more mounting plates, for example the second mounting plate 35, may be configured to be secured to a portion 104 of the picnic table frame 103 that rests on the ground.

In some embodiments, including the illustrated embodiments, the connector may comprise a piped framework 40. The piped framework 40 may be made of any material that is suitable to stably support the child seat 20. Desirably, the piped framework 40 is also made of a material that is durable and weather resistant. In some embodiments, for example, the piped framework may be made of metal and may be treated so as to be weather-resistant. For instance, the piped framework may be made of stainless steel tubing/piping, galvanized steel tubing/piping, or the like.

The connector 30 may comprise at least a first, or primary, portion 41 and a second, or stabilizing, portion 42 that is vertically spaced from the primary portion and that is configured to provide the high chair 10 with enhanced stability. In some embodiments, the primary portion 41 may be attached to the first mounting plate 34 and the stabilizing portion 42 may be attached to the second mounting plate 35. As shown in the embodiment illustrated in FIGS. 1, 4-6, 9, and 10-13, the primary portion 41 of the piped framework 40 may extend horizontally (or substantially horizontally) away from the picnic table 100 a distance and then curve (or angle) upward into a vertically (or substantially vertically) extending section. The stabilizing portion 42 may have a similar shape, but with the top end terminating at the primary portion 41 and providing added support to the primary portion 41.

Although a connector 30 having a piped framework 40 of a particular design and arrangement is shown in FIGS. 1, 4-6, 9, and 10-13, connectors having a piped framework of a different design and arrangement are also contemplated without departing from the scope of the present invention. For instance, in some embodiments the connector may have a plurality of stabilizing portions 42, while in other embodiments a stabilizing portion may be absent. Further, in some embodiments, the connector 30 may have more than one primary portion 41, e.g. more than one portion that forms a direct path between the first end 31 and the second end 32 of the connector 30.

In some embodiments, the connector 30 may further comprise a ground support element 43. The ground support element 43 spans to the ground surface that supports the picnic table 100, thereby distributing the weight from a child occupant of the child seat 20 directly to the ground as well as to the picnic table frame 103. This weight distribution provides a significant increase in stability. The ground support element 43 has a lower end 44 that rests on and optionally is affixed to the ground surface or is positioned below the ground surface. The lower end 44 may comprise, for instance, a flange 45 that provides a desirable ground-contacting surface area. In some embodiments, the flange 45 may comprise one or more apertures (not illustrated) through which a fastening element may be passed into the ground surface to secure the flange to the ground surface. Alternatively, the flange 45 may itself comprise one or more fastening elements (not illustrated) that are passed into the ground surface to secure the flange to the ground surface. The type of fastening element may depend on the identity of the ground surface, e.g. natural earth or an installed surface such as concrete, wood, or the like. In other embodiments, the lower end 44 may be passed into and optionally secured below the ground surface.

Figure 22:
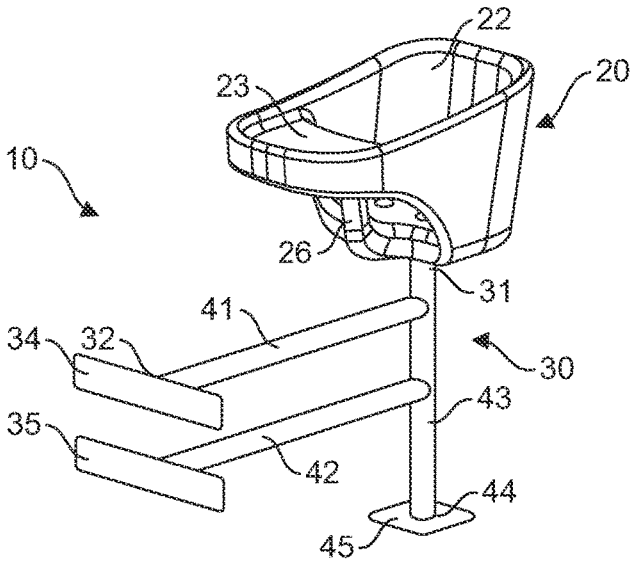
FIG. 22 is a front perspective view of another embodiment of a high chair of the present disclosure having both a connector stabilizing portion and a ground-support element, configured to be positioned and secured to a picnic table such that the tray of the high chair is at substantially the same height as the upper surface of the picnic table.
Figure 23:
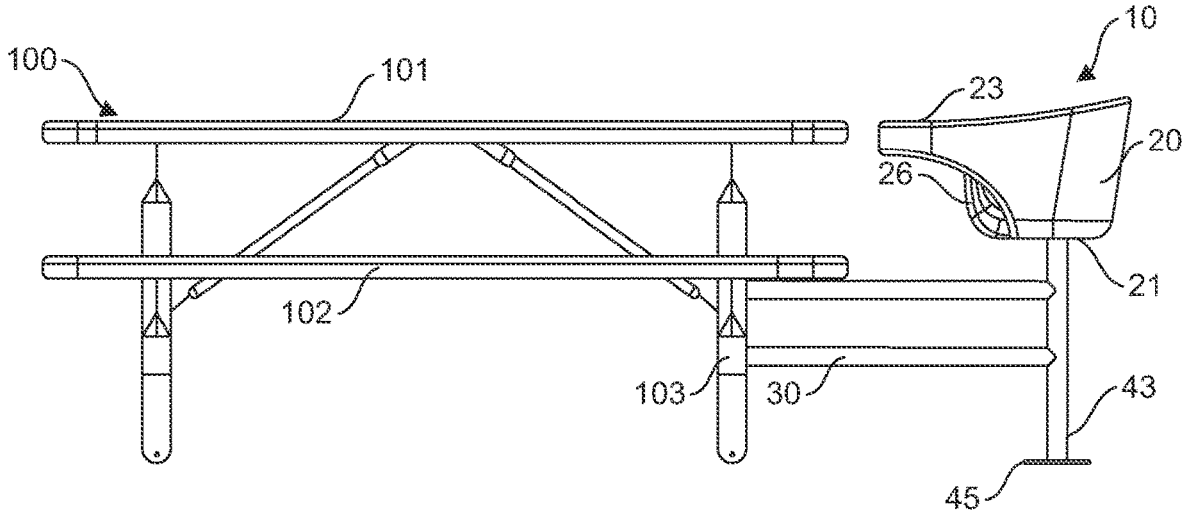
FIG. 23 is a side elevation view of the embodiment of FIG. 22, showing the high chair positioned and secured to a picnic table such that the tray is at substantially the same height as the upper surface of the picnic table.
Figure 24:
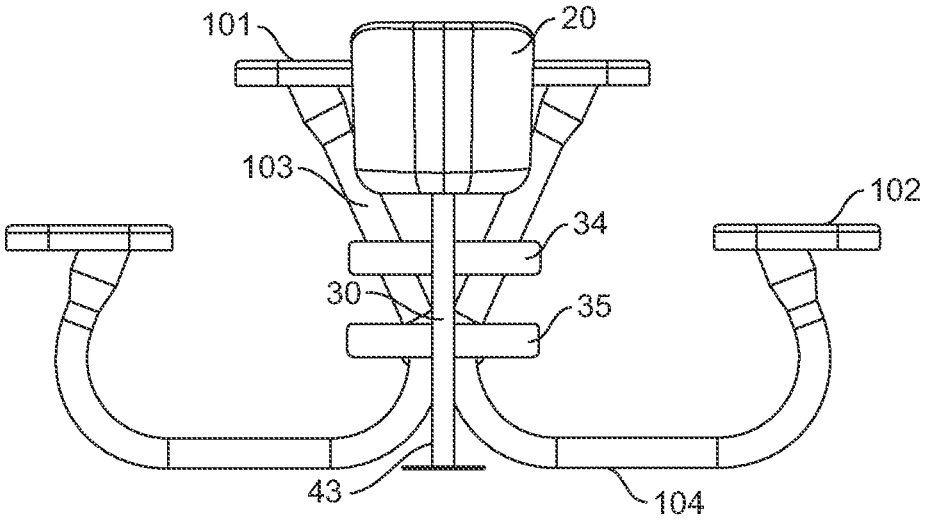
FIG. 24 is a rear elevation view of the embodiment of FIG. 22, showing the high chair positioned and secured to a V-frame picnic table such that the tray is at substantially the same height as the upper surface of the picnic table.
Figure 25:
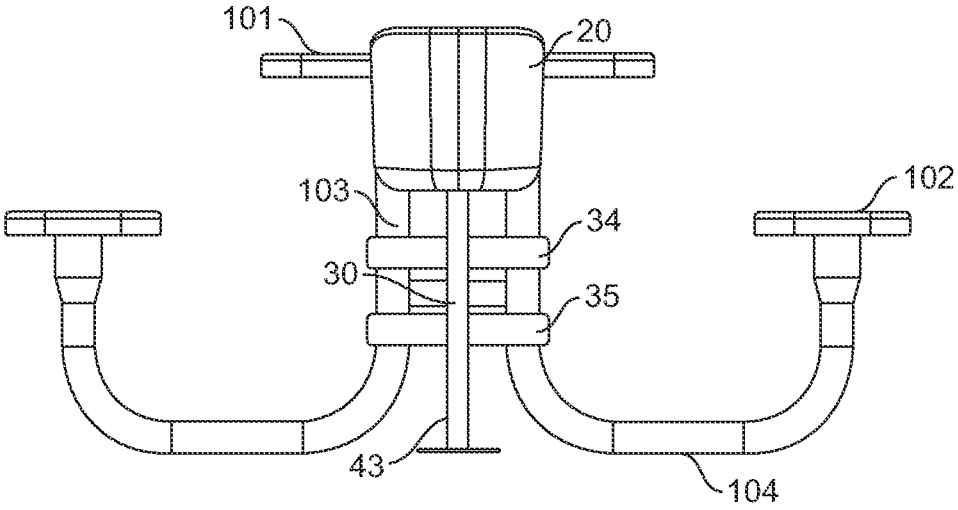
FIG. 25 is a rear elevation view of the embodiment of FIG. 22, showing the high chair positioned and secured to an H-frame picnic table such that the tray is at substantially the same height as the upper surface of the picnic table.

The ground support element 43 may be located at substantially any location along the length of the connector 30 defined by the first and second ends 31, 32. In the embodiment illustrated in FIG. 14, for example, the ground support element 43 is located near the midpoint between the first end of the connector 31 and the second end of the connector 32. In the embodiment illustrated in FIGS. 18 and 22, on the other hand, the ground support element 43 is located at the first end 31 of the connector 30 (spanning directly downward from the bottom of the child seat 20).

Figure 14:
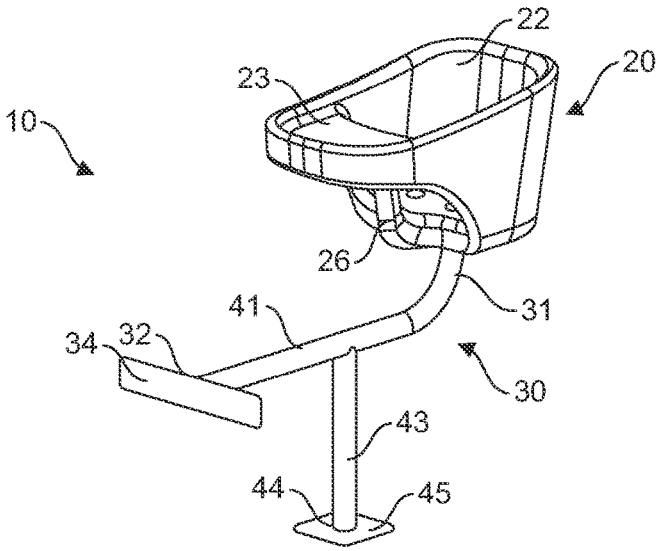
FIG. 14 is a front perspective view of an embodiment of a high chair of the present disclosure having a ground-support element, configured to be positioned and secured to a picnic table such that the tray of the high chair is at substantially the same height as the upper surface of the picnic table.
Figure 15:
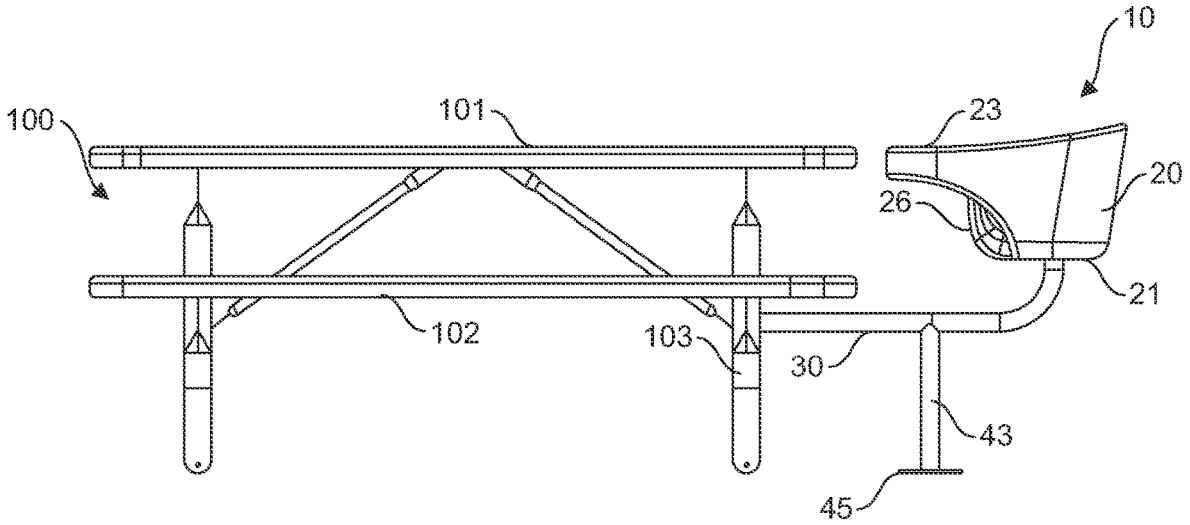
FIG. 15 is a side elevation view of the embodiment of FIG. 14, showing the high chair positioned and secured to a picnic table such that the tray is at substantially the same height as the upper surface of the picnic table.
Figure 16:
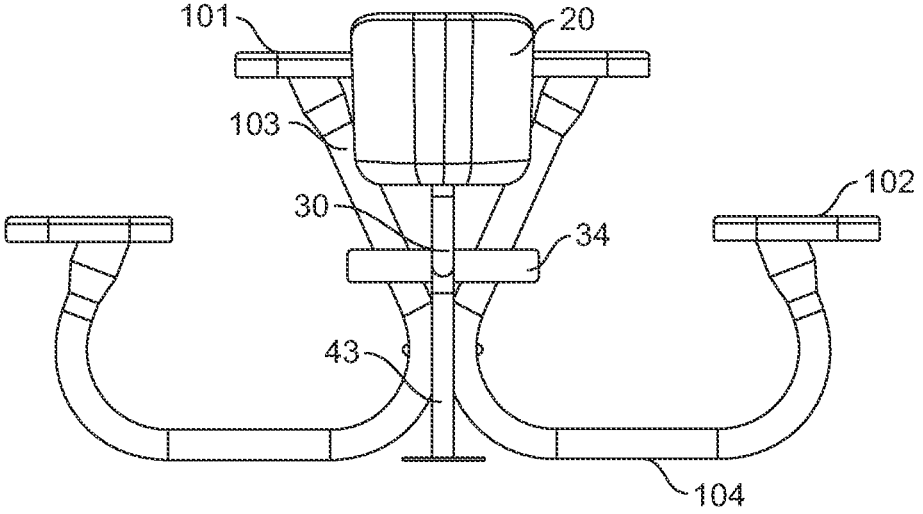
FIG. 16 is a rear elevation view of the embodiment of FIG. 14, showing the high chair positioned and secured to a V-frame picnic table such that the tray is at substantially the same height as the upper surface of the picnic table.
Figure 17:
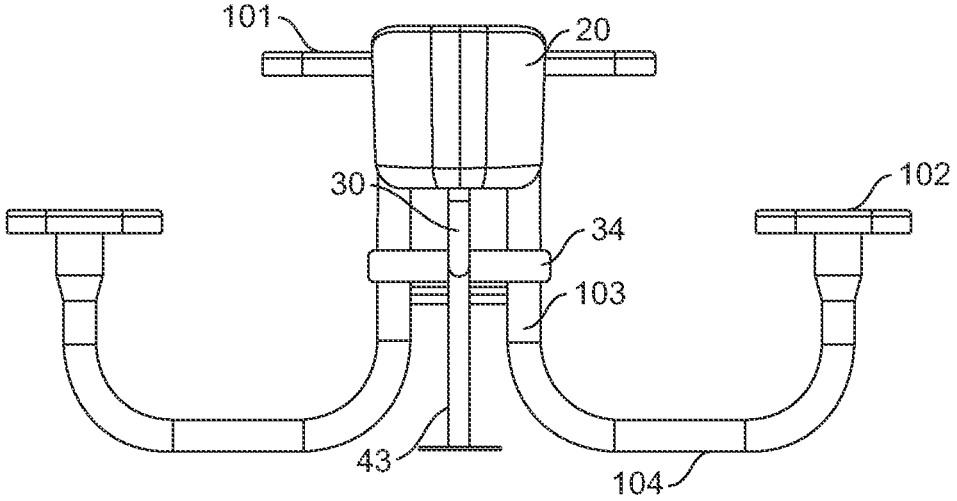
FIG. 17 is a rear elevation view of the embodiment of FIG. 14, showing the high chair positioned and secured to an H-frame picnic table such that the tray is at substantially the same height as the upper surface of the picnic table.
Figure 18:
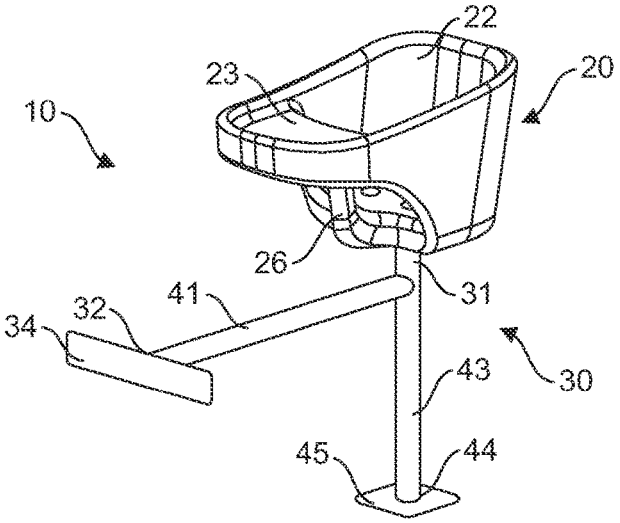
FIG. 18 is a front perspective view of another embodiment of a high chair of the present disclosure having a ground-support element, configured to be positioned and secured to a picnic table such that the tray of the high chair is at substantially the same height as the upper surface of the picnic table.
Figure 19:
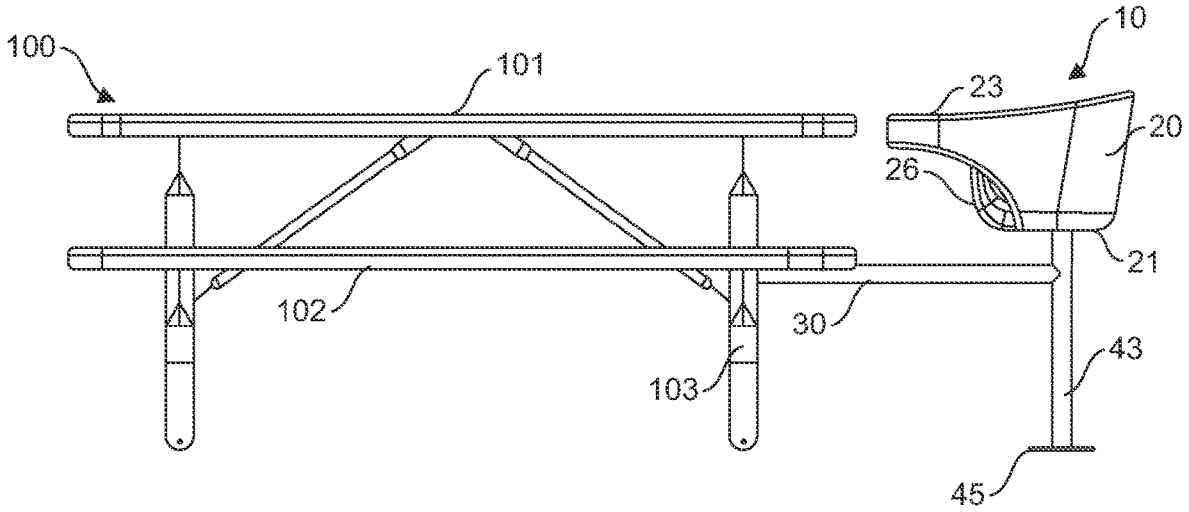
FIG. 19 is a side elevation view of the embodiment of FIG. 18, showing the high chair positioned and secured to a picnic table such that the tray is at substantially the same height as the upper surface of the picnic table.
Figure 20:
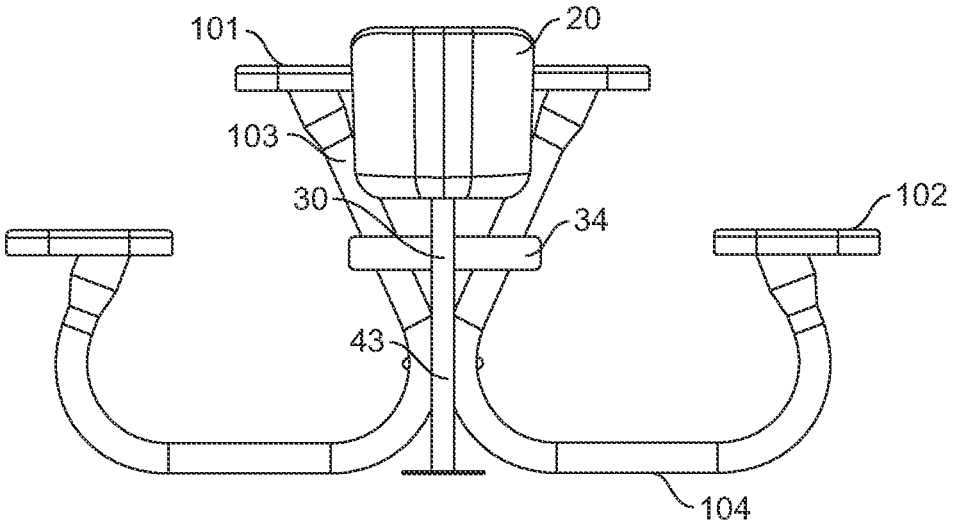
FIG. 20 is a rear elevation view of the embodiment of FIG. 18, showing the high chair positioned and secured to a V-frame picnic table such that the tray is at substantially the same height as the upper surface of the picnic table.
Figure 21:
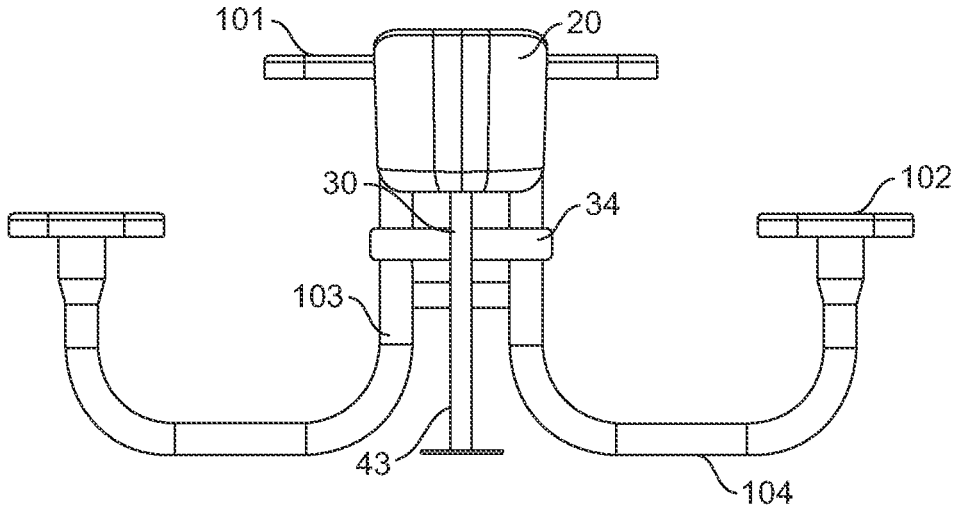
FIG. 21 is a rear elevation view of the embodiment of FIG. 18, showing the high chair positioned and secured to an H-frame picnic table such that the tray is at substantially the same height as the upper surface of the picnic table.

In some embodiments, such as that shown in FIGS. 14 and 18, the ground support element 43 may take the place of the stabilizing portion 42. However, in other embodiments, such as that shown in FIG. 22 for example, the connector 30 may comprise both a stabilizing portion 42 and a ground support element 43.

In the illustrated embodiments, the ground support element 43 is shown as being a vertical beam. However, in other embodiments, the ground support element 43 may be angled. For example, the ground support element 43 may be an angled beam, such that the lower end 44 of the ground support element is positioned farther away from the picnic table 100 than the upper end of the ground support element.

Moreover, although the illustrated embodiments of the connector 30 comprises a piped framework 40, other embodiments of the connector may take on other forms. For example, in some embodiments, at least a portion of the connector may be made of a durable plastic material, such as the same material that may be used to prepare the child seat 20. Indeed, in some embodiments, at least a portion of the connector 30 may be molded integrally with the child seat 20.

Some embodiments of the high chair 10 of the present disclosure may be configured so that, when secured to a picnic table 100, the entirety of the child seat 20 is positioned vertically above the top, or dining, surface 101 of the picnic table. For instance, the base 21 of the child seat 20 may be positioned a predetermined and defined distance above the top surface 101 of the picnic table 100 and/or a predetermined and defined distance above a bench seat 102 of the picnic table. By placing the child seat 20 above the top surface of the picnic table 101, the high chair 10 may be configured so that a child occupant of the high chair and an adult occupant of one of the picnic table bench seats 102 are at a common eye level, facilitating eye contact and face-to-face interaction.

When a child reaches the young age of a few months, the child and caretaker begin to develop a harmonic meeting of the minds. This is largely achieved through a coordination of behavior that begins with eye contact. For example, the child may look into its mother's eyes and smile or laugh. This, in turn, will cause the mother to smile or laugh in response. This coordination of behavior has been described using terms such as interactive synchrony, matching, coherence, co-occurrence, attunement, and, more generally, bonding. For simplicity, this face-to-face coordination of behavior between child and caretaker will herein generally be referred to as attunement.

Attunement occurs when a caretaker and infant synchronize their gaze patterns and the affective tone of their interaction. As the caretaker is sensitive and responsive to changes in the child's emotions, the child responds to the caretaker's sensitive behaviors. As caretaker and child become attuned to each other, their interactions become more synchronized and harmonious.

It has been found that attunement is important both for establishing a successful relationship between the child and caretaker and for promoting the infant's emotional development. The importance of this face-to-face coordination of behavior between child and caretaker continues throughout infancy and into toddlerhood.

Attunement between a child and caretaker is critical for the establishment of a mutual understanding between the child and the caregiver. Attunement has been shown to produce a decrease in negative behavior, such as crying and infant gaze aversion, as well as in increase in positive behaviors, such as attentiveness and affective displays, e.g. smiling and laughing. In general, attunement results in a child having an increased enjoyment of the caretaker-child interactions. As such, attunement is an important factor in developing a relationship that is close, mutually binding, cooperative, and affectively positive. Children growing up with caretakers who are responsive to their needs and whose interactions are infused with happy emotions adopt a willing, responsive stance toward caretaker influence.

Attunement also plays an important role in promoting the emotional development of the child. A child's learning of social skills and conventional forms of communication and culture begins with attunement. A child who does not experience attunement has difficulty forming healthy attachments and is more likely to become emotionally brittle. It has also been theorized that attunement buffers the child against excessive surges of emotion and helps orchestrate genetic signals that govern optimal brain development during childhood as well as further into adolescence and young adulthood.

The phrase common eye level, as used herein, does not require that the caretaker's eyes and the child's eyes be at exactly the same height or distance from the ground. Rather, common eye level, as used herein, encompasses any arrangement in which the line of sight of the adult occupant of the picnic table 100 and the line of sight of the child occupant of the high chair 10 are generally aligned such that each may naturally and comfortably maintain eye contact with the other while seated at the picnic table. When a common eye level is achieved, the adult occupant of the picnic table 100 should not have to look significantly downward, e.g. to near the level of the dining surface 101, and the child occupant of the high chair 10 should not have to look significantly upward in order to interact with one another.

Figure 2:
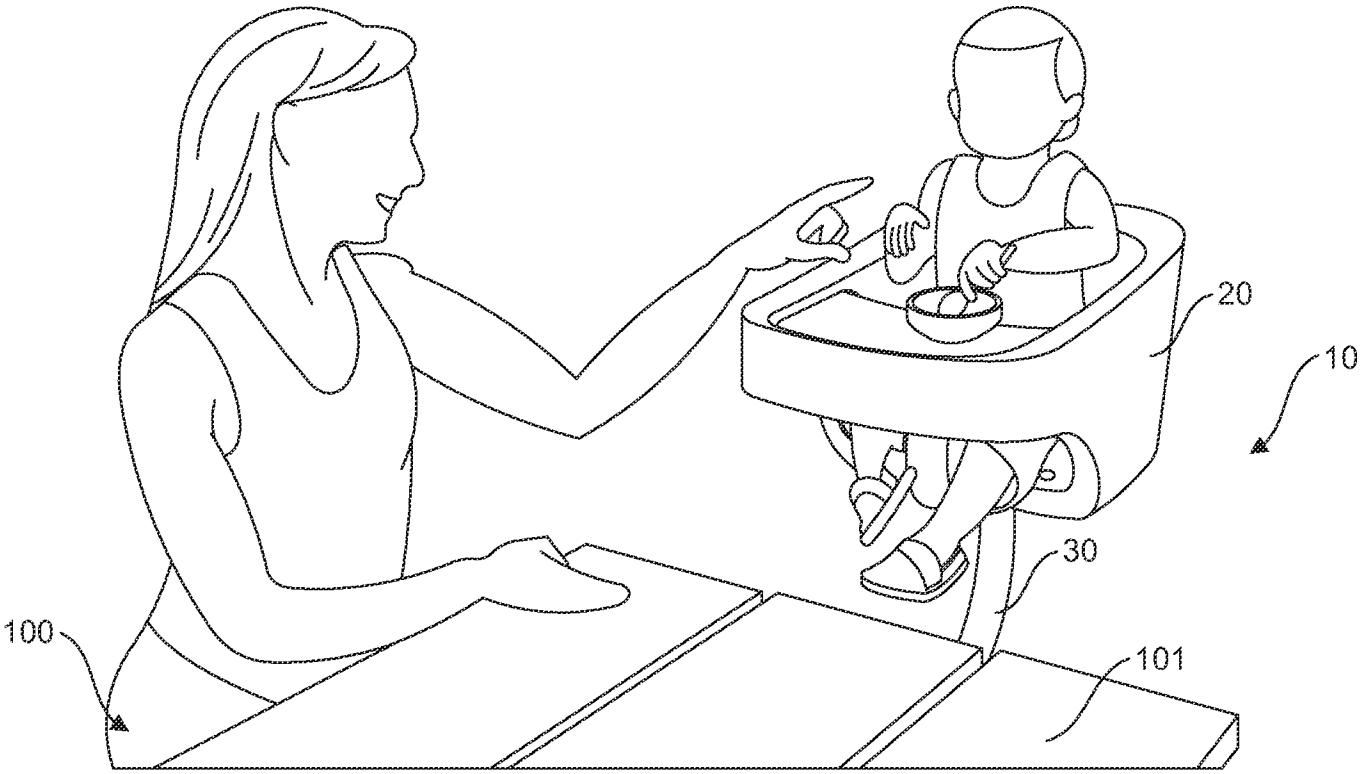
FIG. 2 is a perspective view of an embodiment of a high chair secured to a picnic table, showing how the high chair facilitates interaction and attunement between a child occupant of the high chair and a caretaker occupant of the picnic table bench seat.
Figure 3:
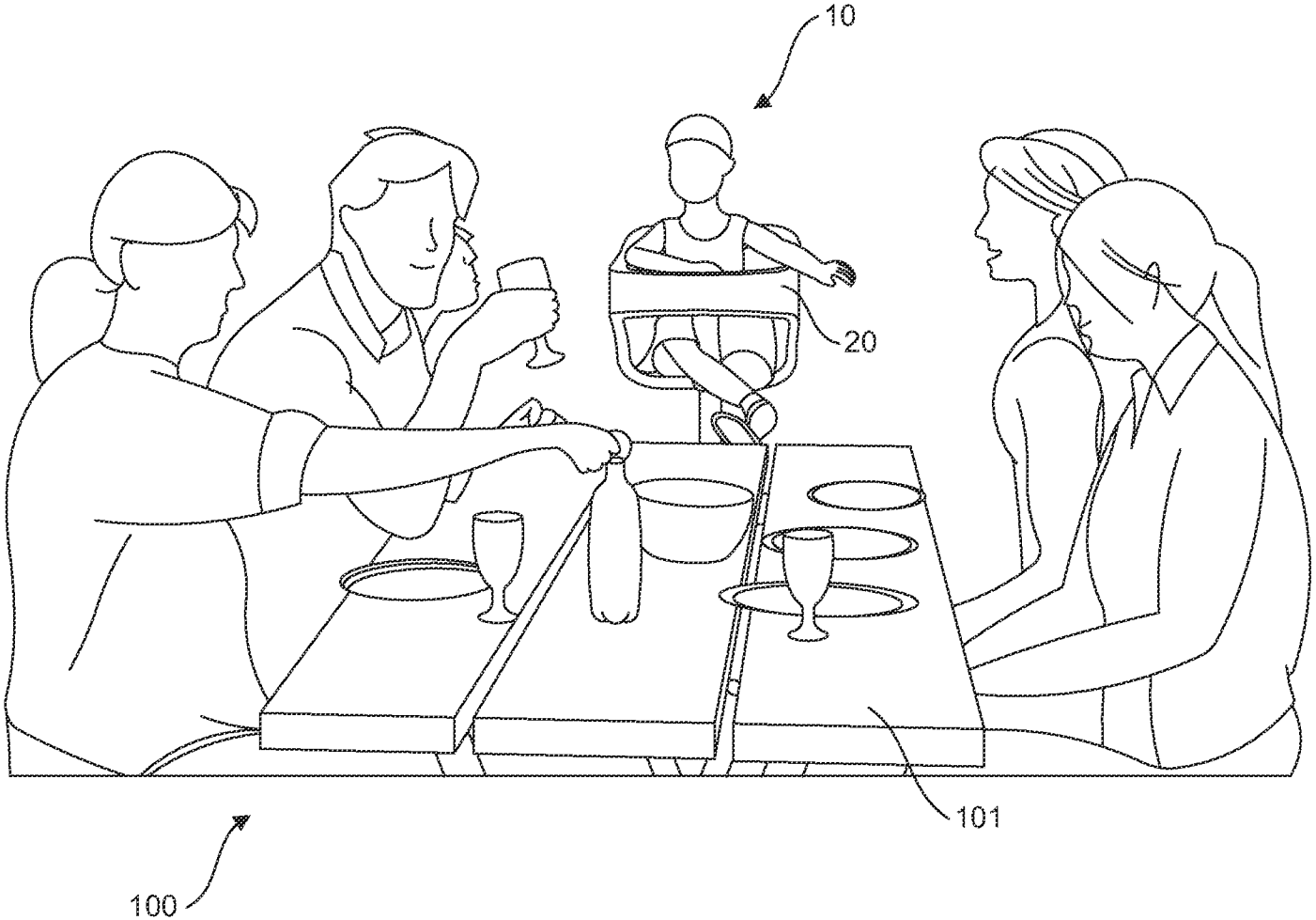
FIG. 3 is a perspective view of an embodiment of a high chair secured to a picnic table, showing how the high chair facilitates interaction between a child occupant of the high chair and a family occupying the picnic table bench seats.

A high chair 10 that is positioned vertically higher than the upper surface of a picnic table is shown in FIGS. 1 through 3 and 9. FIGS. 2 to 3 show how embodiments of the high chair 10 of the present disclosure promote and facilitate interaction and attunement between a child and a caretaker. FIG. 3 also shows how embodiments of the high chair 10 of the present disclosure makes a child an equal member of a family or group while seated at a picnic table 100, such as during a shared meal. By placing the child at a common eye level with the adults, interaction and attunement between the adults and the child is enhanced.

In some embodiments, for instance, the high chair 10 may be configured and secured to the picnic table frame 103 so that the base 21 of the child seat 20 is positioned at least two inches above the upper surface of the picnic table 101, alternatively at least three inches above the upper surface of the picnic table, alternatively at least four inches above the upper surface of the picnic table, alternatively at least five inches above the upper surface of the picnic table.

Similarly, in some embodiments, the high chair 10 may be configured and secured to the picnic table frame 103 so that the base 21 of the child seat 20 is positioned at least twelve inches above a bench seat of the picnic table 102, alternatively at least thirteen inches above a bench seat of the picnic table, alternatively at least fourteen inches above a bench seat of the picnic table, alternatively at least fifteen inches above a bench seat of the picnic table, alternatively at least sixteen inches above a bench seat of the picnic table.

Other embodiments of the high chair 10 of the present disclosure may be configured so that, when secured to a picnic table 100, the tray 23 of the child seat 20 is positioned at substantially the same height as the top, or dining, surface 101 of the picnic table. Examples are shown in FIGS. 10 through 25. By placing the tray 23 of the child seat 20 at substantially the same height as the top surface 101 of the picnic table 100, food and drink items may be easily shared between the adult occupants of the bench seats 102 and the child occupant of the high chair.

In some embodiments, for instance, the high chair 10 may be configured and secured to the picnic table frame 103 so that the tray 23 of the child seat 20 is positioned within six inches of the upper surface of the picnic table 101, alternatively within five inches of the upper surface of the picnic table, alternatively within four inches of the upper surface of the picnic table, alternatively within three inches of the upper surface of the picnic table, alternatively within two inches of the upper surface of the picnic table, alternatively within one inch of the upper surface of the picnic table.

In some embodiments, for instance, the high chair 10 may be configured and secured to the picnic table frame 103 so that the tray 23 of the child seat 20 is positioned between 28 and 38 inches above the ground surface that supports the picnic table, alternatively between 29 and 37 inches above the ground surface, alternatively between 30 and 36 inches above the ground surface, alternatively between 31 and 35 inches above the ground surface, alternatively between 32 and 34 inches above the ground surface.

It can be seen that the described embodiments provide a unique and novel high chair 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A high chair configured to be mounted to a picnic table, comprising:

a child seat, the child seat comprising a base, a child support structure, and a tray for holding food items;

a connector having a first end attached to the child seat and a second end configured to be secured to a frame of the picnic table;

wherein the second end of the connector comprises one or more mounting plates; and wherein at least one of the one or more mounting plates extends horizontally such that a first end of the mounting plate is securable to a first leg of the picnic table and a second end of the mounting plate is securable to a second leg of the picnic table.

2. The high chair of claim 1, wherein the second end of the connector is securable to a picnic table V-frame, H-frame, X-frame, or any combination thereof.

3. The high chair of claim 1, wherein the high chair is configured so that when the high chair is secured to the picnic table, the base of the child seat is positioned at least fourteen inches above a seat of the picnic table.

4. The high chair of claim 1, wherein the high chair is configured so that when the high chair is secured to the picnic table, the tray of the child seat is positioned at substantially the same height as the top surface of the picnic table.

5. The high chair of claim 1, wherein at least one of the first end and the second end of the mounting plate comprises a slot spanning a horizontal distance sufficient to allow the high chair to be secured to picnic table frames having: (i) varying leg dimensions, (ii) first and second legs located at varying horizontal distances, or (iii) both (i) and (ii).

6. The high chair of claim 1, wherein the second end of the connector comprises a first mounting plate and a second mounting plate, the first mounting plate and the second mounting plate being vertically spaced from one another.

7. The high chair of claim 6, wherein the connector comprises a primary portion and a stabilizing portion, the primary portion and the stabilizing portion being vertically spaced from one another, and wherein the primary portion comprises the first mounting plate and the stabilizing portion comprises the second mounting plate.

8. The high chair of claim 1, wherein the connector comprises a ground support element configured to contact a ground surface so as to distribute weight from the child seat to the ground.

9. The high chair of claim 8, wherein a lower end of the ground support element comprises a flange that is fastenable to the ground surface.

10. The high chair of claim 1, wherein the child seat is configured to be occupied by children having ages between one and four.

11. The high chair of claim 1, wherein the child seat further comprises a divider spanning from the base to the tray to define leg openings.

12. The high chair of claim 1, wherein the child seat is an integral molded plastic unit.

13. The high chair of claim 1, wherein the high chair is configured so that when the high chair is secured to the picnic table, the base of the child seat is positioned above the top surface of the picnic table.

14. The high chair of claim 13, wherein the high chair is configured so that when the high chair is secured to the picnic table, the base of the child seat is positioned at least three inches above the top surface of the picnic table.

15. The high chair of claim 14, wherein the high chair is configured so that when the high chair is secured to the picnic table, the base of the child seat is positioned at least five inches above the top surface of the picnic table.

16. A picnic table comprising the high chair of claim 1.

17. The picnic table of claim 16, wherein the high chair is permanently secured to the picnic table.

18. The picnic table of claim 17, wherein the second end of the connector is secured to the frame of the picnic table by at least one tamper-resistant fastener.

* * * * *